US005647402A

United States Patent [19]

Palau et al.

[11] Patent Number: 5,647,402

[45] Date of Patent: Jul. 15, 1997

[54] ENCLOSED SUPPORT BEAM AND LUBRICATION SYSTEM FOR LOOM DRAWING APPARATUS

[75] Inventors: Joseph Palau, Duingt; Jean-Paul Froment, Doussard, both of France

[73] Assignee: Staubli Faverges, Faverges, France

[21] Appl. No.: 641,648

[22] Filed: May 1, 1996

[30] Foreign Application Priority Data

May 12, 1995 [FR] France ..... 95.05882

[51] Int. Cl.[6] ..... D03C 1/14; D03C 1/16; D03D 49/02

[52] U.S. Cl. ..... 139/1 R; 139/57; 184/26

[58] Field of Search ..... 139/1 R, 57, 58, 139/66 A; 184/26

[56] References Cited

U.S. PATENT DOCUMENTS

| | | | |
|---|---|---|---|
| 4,003,409 | 1/1977 | Steffens | 139/1 R |
| 4,635,684 | 1/1987 | Hintsch | 139/1 R |
| 5,291,970 | 3/1994 | Vinciguerra et al. | 184/11.2 |

FOREIGN PATENT DOCUMENTS

| | | |
|---|---|---|
| 422364 | 8/1990 | European Pat. Off. . |
| 535726 | 9/1992 | European Pat. Off. . |
| 595380 | 9/1993 | European Pat. Off. . |
| 970624 | 8/1948 | France . |
| 2317395 | 7/1976 | France . |

*Primary Examiner*—Andy Falik
*Attorney, Agent, or Firm*—Dowell & Dowell

[57] ABSTRACT

A weaving system is provided as a tightly closed beam or casing for containing an oil bath and lubricating system for the moveable parts of the weaving system. The beam includes upstanding lateral cheeks which may support a drive shaft and pivot pins on which oscillating members are moveably pivoted by a drawing system to the heddle frames of the weaving machine.

12 Claims, 3 Drawing Sheets

Fig. 1
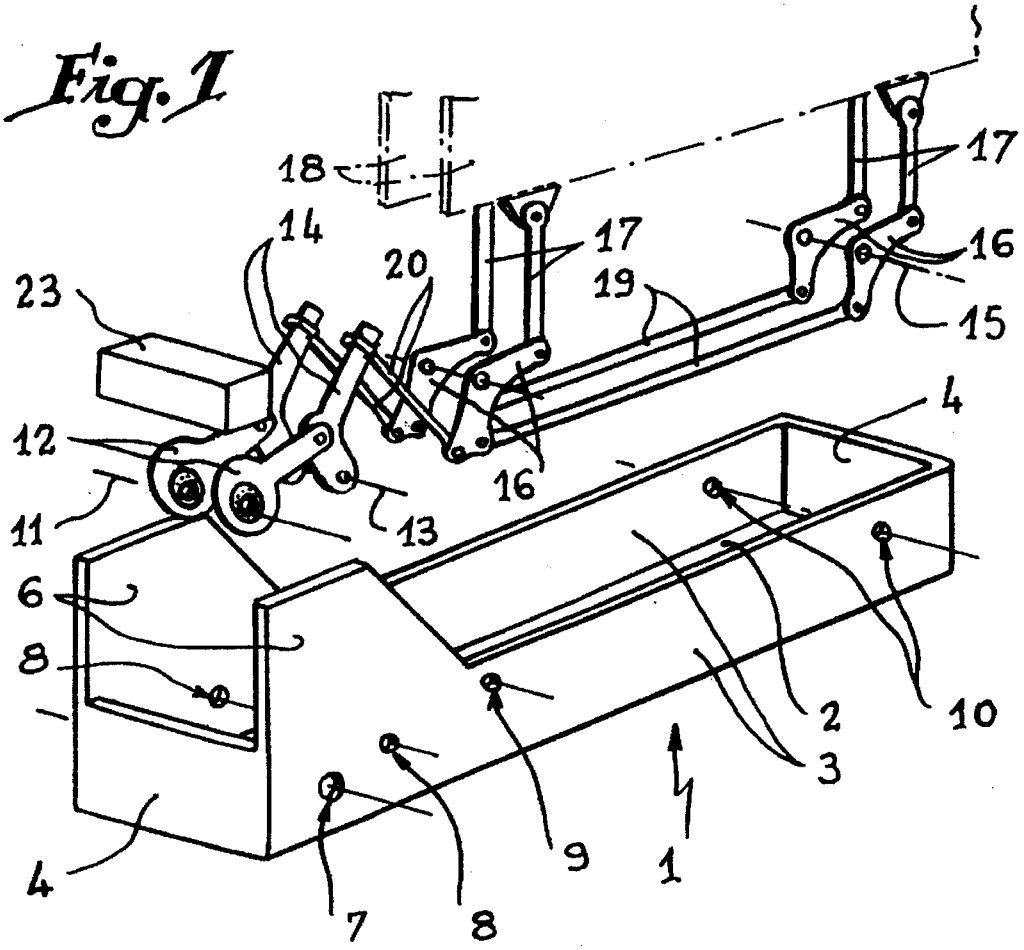
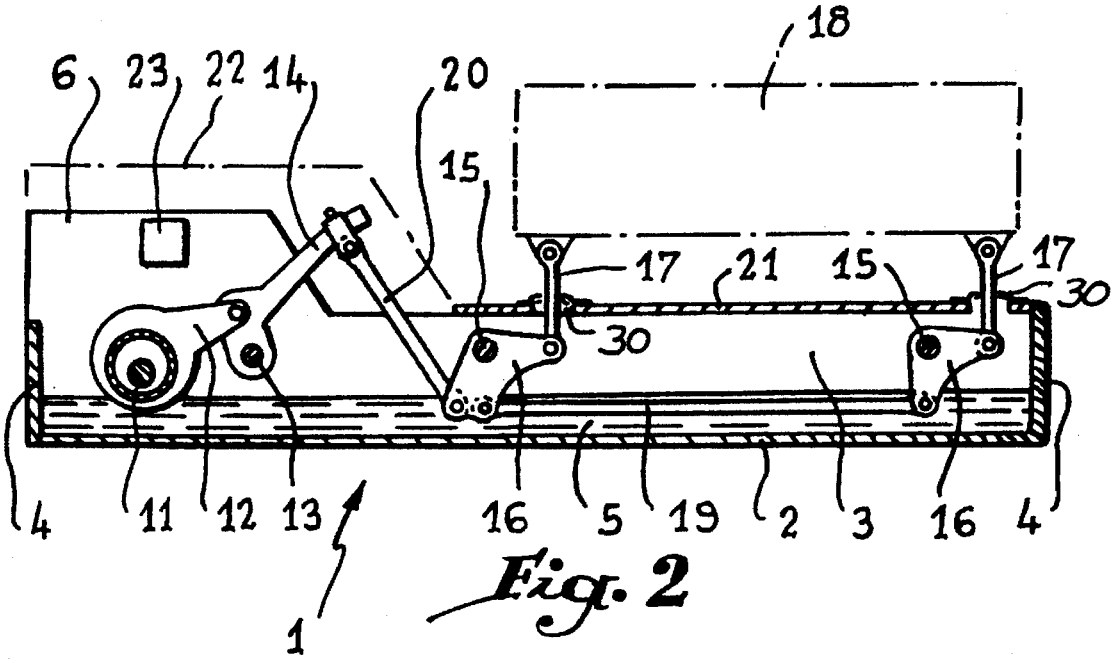
Fig. 2

ENCLOSED SUPPORT BEAM AND LUBRICATION SYSTEM FOR LOOM DRAWING APPARATUS

BACKGROUND OF THE INVENTION

1. Field of the Invention

The present invention relates to dobbies and other weaving systems of the rotary type for forming the shed in weaving machines.

2. History of the Related Art

In their conventional structure, weaving systems are known to comprise a certain number of oscillating members which are mounted to pivot on a common fixed pin and which are connected to conventional heddle frames of a weaving machine by a system of drawing incorporating return levers and transmission rods, which levers themselves pivot on fixed pins carried by a frame supporting the conventional casing of the weaving system.

Applicants' French Patent Application No. 95/05241 filed on Apr. 26, 1995, describes a support frame for weaving system comprising a beam whose cross-section is in the form of an upwardly open U whose longitudinal flanges are arranged to support the pivot pins for the return levers of the system of drawing and which ensure vertical control of the heddle frames of the weaving machine. In the embodiment described and illustrated in that Patent Application, the weaving system is fixed against a box element added at one of the ends of the support beam.

The present invention is based on the fact that, by appropriately arranging it, such a support beam may advantageously take the place of the conventional casing for the weaving system.

SUMMARY OF THE INVENTION

The present invention relates to a weaving system of the rotary type for forming the shed in weaving machines, of the type comprising oscillating members which are actuated by a drive shaft and which, mounted to pivot on a fixed pin, are connected to the conventional heddle frames by a system of drawing incorporating return levers and transmission rods. The invention is characterized in that the support frame, constituted in manner known per se by a beam of upwardly open U-section, is closed tightly to contain lubricating oil and includes at one of its ends two upstanding lateral cheeks which may support the drive shaft and the pivot pin for the oscillating members. The support frame is equipped with a distribution system for lubricating the components therein with the oil that it contains.

In other words, the invention essentially consists in providing at one of the ends of the U-sectioned beam which forms the support frame, two vertically extending lateral cheeks which may be used to support the drive shaft and the common pivot pin for the oscillating members of the weaving system, and in the fluid-tight closing of the beam so that it can contain the conventional oil bath intended for lubricating the moveable elements of the weaving system and of the system of drawing associated therewith, by means of an incorporated lubrication system.

It is appreciated that the U-sectioned beam is advantageously closed by a cover which prevents textile flock dropping in the oil bath contained therein, which cover has appropriate slots made therein for the passage of the vertical rods intended for moving the heddle frames. It is against this cover that are fixed pipes for directing a flow of oil on the different points of articulation of the return levers and the oscillating members of the weaving system, which members may thus present simple shapes which, due in particular to their improved accessibility, facilitate the adjustment of the shed.

BRIEF DESCRIPTION OF THE DRAWINGS

The invention will be more readily understood on reading the following description with reference to the accompanying drawings, in which:

FIG. 1 is an assembly view in perspective illustrating the general arrangement of a weaving system according to the invention.

FIG. 2 is a longitudinal section of the system according to FIG. 1, after assembly of the elements shown in FIG. 1.

DESCRIPTION OF PREFERRED EMBODIMENT

Figure 3:
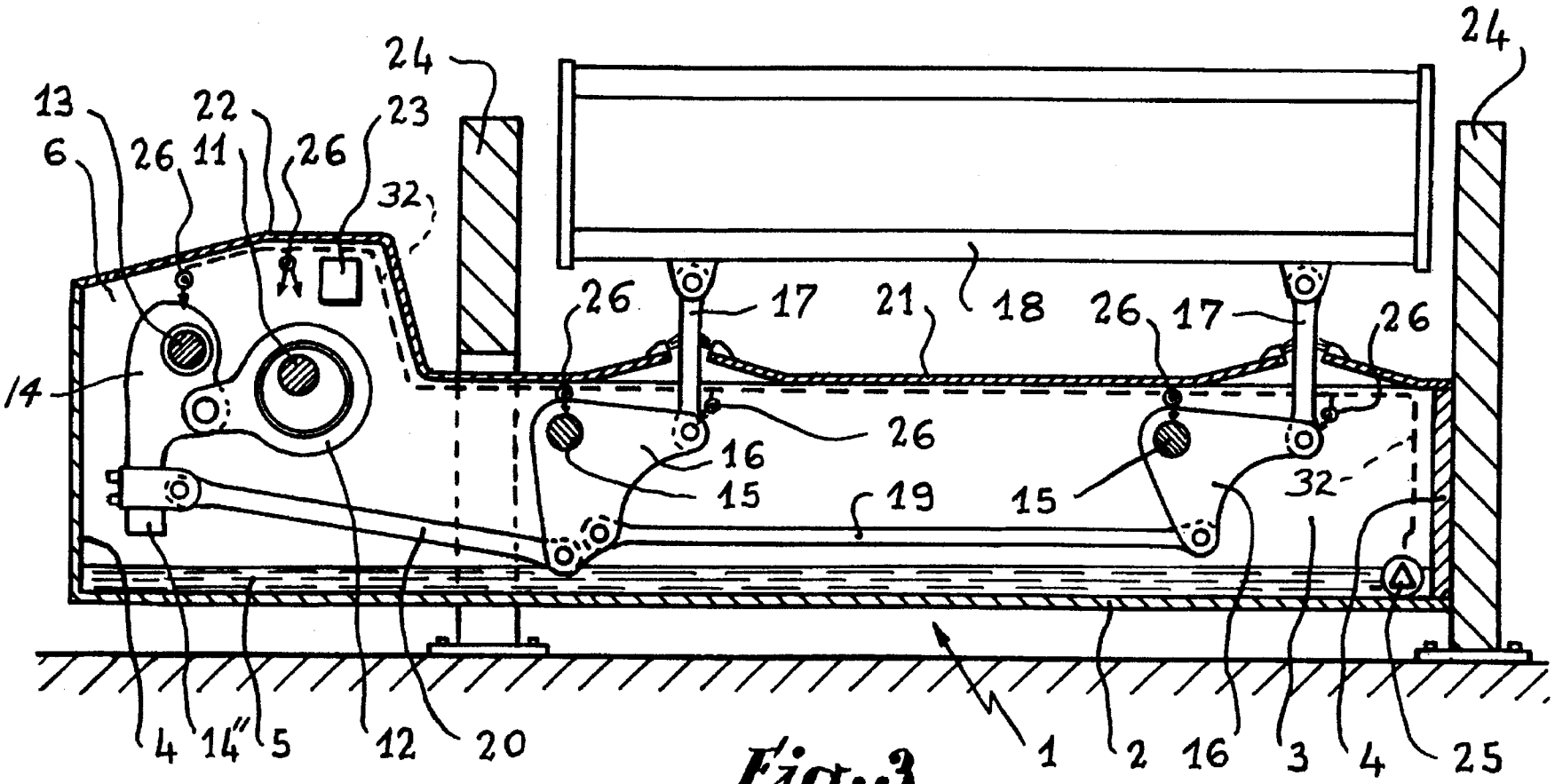
FIG. 3 is a longitudinal section showing more precisely the system for lubricating the weaving system in the case of a rotary dobby of the type incorporating connecting rods and eccentrics.

Referring now to the drawings, and firstly to FIGS. 1 and 2, reference 1 designates the beam or housing which constitutes simultaneously the support frame and the casing of the weaving system. This beam 1 presents an upwardly open U-section which is defined by a flat bottom 2, two longitudinal side walls 3 and two transverse end partitions or walls 4. The end walls ensure a perfectly tight closure so that the beam 1 can contain a quantity of oil, referenced 5 in FIG. 2, without leakage.

At one of the ends of beam 1, the two side walls 3 include two upstanding lateral cheeks 6. Although, in the embodiment illustrated, the cheeks 6 are directly secured to the side walls 3, they may equally well be constituted by two plates added by welding or bolting on the side walls. In wall 3, and in cheeks 6 are made four pairs of openings referenced 7, 8, 9 and 10, respectively, it being observed that the two openings of each pair are aligned transversely on one and the other wall or cheek. The pair of openings 7 receive roller bearings (not shown) which support the drive shaft 11 for driving the rods 12 actuating a rotary dobby. The pair of openings 8 receive the ends of a fixed pin 13 on which all the oscillating members 14 pivot. In each of the pairs of openings 9 and 10 are retained the ends of fixed pins 15 which form common pivots for assemblies of return levers 16 connected by vertical rods 17 to the heddle frames 18 of the weaving machine.

The two levers 16 associated with the same frame 18 are coupled to each other by a horizontal rod 19. One of the levers is, in addition, coupled by an oblique rod 20 to one of the oscillating members 14, so that the reciprocating angular displacement of member 14 causes vertical displacement of the frame 18 to which it is coupled.

The weaving system according to the invention is completed by a cover 21 which covers that part of the beam 1 disposed beneath the frames 18. The cover has two transverse slots 30 made therein for the passage of the two series of vertical rods 17. This cover 21 is extended by a removable hood 22 which provides protection of the oscillating members 14, the actuation rods 12 and the reading device 23 which effects programmed control of the rods 12.

Consequently, a very sturdy construction assembly is obtained which is capable of being mounted in the lower part of the weaving machine with which it is intended to be associated. Once the assembly is placed in position, it suffices to connect the rods 17 to the heddle frames 18.

FIG. 3 clearly illustrates the assembly of a rotary dobby according to the invention whose support frame is solidly fastened to the two conventional vertical structures or elements 24 of a traditional weaving machine. This dobby is equipped with a lubricating system which comprises a pump 25 for supplying by way of conduits 32 a series of transverse spray or lubrication pipes 26 disposed above the pivot pins 15 of the return levers 16, above the pin 13 on which pivot the oscillating members 14, above the shaft 11 and above the points of coupling of rods 19 and 20 and rods 17.

As the oil issuing from corresponding pipe 26 flows freely and as the bottom 2 of beam 1 is flat, a system of drawing underneath is provided for wherein each member 14 extends downwardly from an upper hub engaged on pin 13 to an end 14". This simple profile facilitates adjustment of the point of coupling of each of the oblique rods 20 on members 14 for adjustment of the shed after the upper covering hood 21-22 has been removed.

Figure 4:
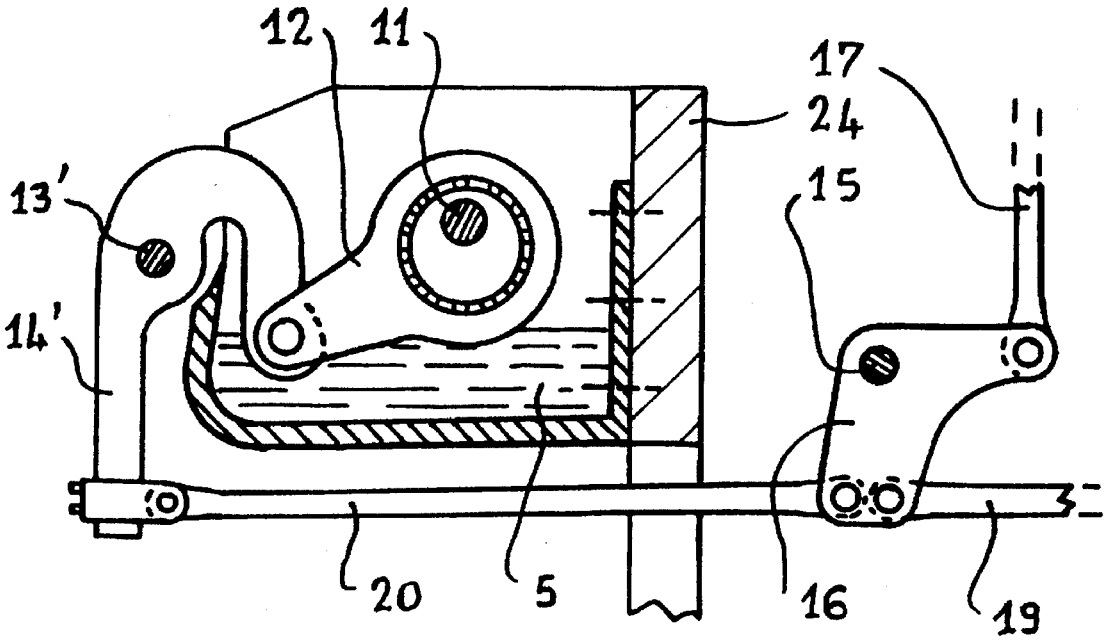
PRIOR ART Fig. 4
FIG. 4 shows the arrangement of conventional drawing systems from underneath.

It suffices to compare the left-hand part of FIG. 3 with FIG. 4 which shows the complex profile of the oscillating members 14' of a conventional system for underneath drawing. It is observed that the pivot pin 13' of members 14' cannot be lubricated efficiently as they are placed outside the conventional casing of the weaving system. The right-hand profile of members 14 ensures a rigidity and resistance much greater than those of members 14'. It will be noted that the underneath drawing system according to FIG. 3 makes it possible to reduce the dimensions of the whole assembly in both the vertical and horizontal directions; moreover, motion diagrams have been made which prove this arrangement is advantageous for certain weaving conditions, for example low cross-weavings.

Figure 5:
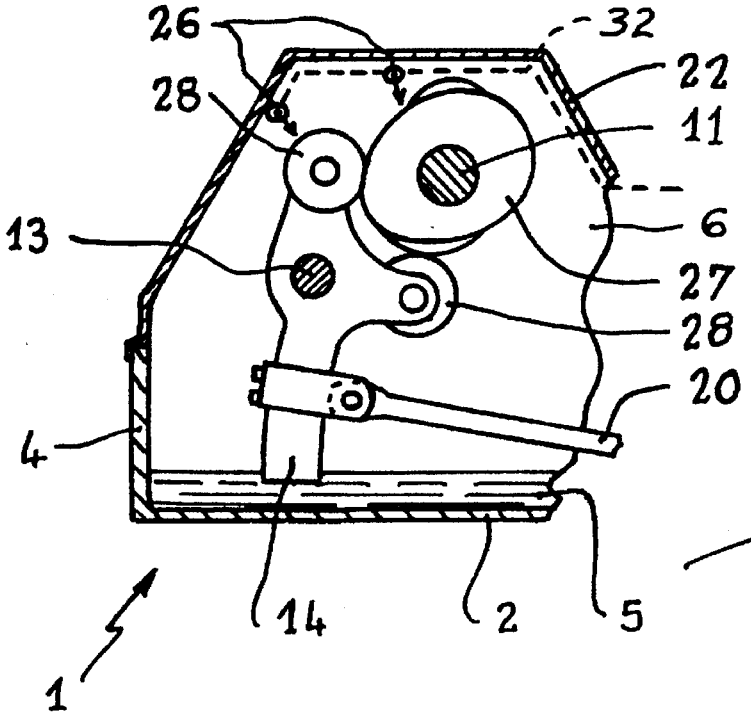
FIG. 5 illustrates the application of the invention to a rotary system incorporating cams.

It goes without saying that the invention is applicable to weaving systems incorporating cams of the type illustrated in FIG. 5, in which the oscillating members 14 coupled to the oblique rods 20 are controlled by complementary cams 27 which are fitted on the drive shaft 11 and act on rollers 28 carried by the members 14.

What is claimed is:

1. In a weaving system for forming a shed in a weaving machine wherein the weaving system includes heddle frames connected by way of return levers and transmission rods to oscillating members driven by a drive shaft, the improvement comprising:

a support beam having a bottom wall, opposing side walls and opposite end walls which are close in fluid-tight relationship with respect to one another so as to permit a lubricating oil to be contained within said support beam, each of said opposing side walls including a cheek extending upwardly therefrom adjacent one end of said support beam, said opposing side walls being adapted to support the drive shaft adjacent said one end of said support beam, first pin means adapted to support the oscillating members mounted to said opposing side walls in spaced relationship from the drive shaft and adjacent one end of said support beam and second pin means spaced from said first pin means towards an opposite end of said support beam adapted to support the return levers, and a lubricating system mounted to said support beam for circulating lubricating oil within said support beam.

2. The weaving system of claim 1 wherein said weaving system includes a pump, a plurality of lubricating pipes mounted within said support beam adjacent each of said first and second pin means and the drive shaft, and conduit means for connecting said pump in fluid communication with said lubricating pipes.

3. The weaving system of claim 2 including a cover for closing said support beam and spaced openings in said cover through which rods may extend from the return levers to the heddle frames.

4. The weaving system of claim 3 in which said cover includes a hood portion removably mounted over said cheeks.

5. The weaving system of claim 4 wherein said cheeks are adapted to support the drive shaft and said first pin means to said support beam.

6. The weaving system of claim 1 wherein said cheeks are adapted to support the drive shaft and said first pin means to said support beam.

7. The weaving system of claim 1 wherein said lower wall of said support beam is flat.

8. A weaving system for forming a shed in a weaving machine wherein the weaving system includes a drive shaft for imparting movement to heddle frames, comprising:

a support beam having a bottom wall, opposite side walls, and opposing end walls which are connected in fluid-tight engagement with respect to one another, said opposite side walls including upwardly extending cheeks, first pin means mounted to said cheeks, oscillating lever members mounted to said first pin means and having end portions extending towards said bottom of said support beam, second pin means mounted to said opposing side walls in spaced relationship from said first pin means, return levers mounted to said second pin means, said return levers having end portions extending towards said bottom wall of said support beam, first rod means pivotally connecting said end portions of said oscillating levers to said end portions of said return levers and second rod means connected to said return levers and adapted to connect said return levers to the heddle frames, a lubricating system mounted to said support beam, said lubricating system including a pump connected by at least one conduit to lubricating pipes mounted adjacent said first and second pin means whereby a lubricant may be supplied at the first and second pin means.

9. The weaving system of claim 8 including a cover for closing said support beam.

10. The weaving system of claim 9 including spaced openings in said cover through which said second rod means extend.

11. The weaving system of claim 9 in which said cover includes a hood removably mounted over said cheeks.

12. The weaving system of claim 9 in which said lubricating system includes further lubricating pipes mounted adjacent said second rod means and the drive shaft within said support beam.

* * * * *